US005709009A

United States Patent [19]

Lasson et al.

[11] Patent Number: 5,709,009

[45] Date of Patent: Jan. 20, 1998

[54] DOOR CLOSER FOR THE NON-FIRE SIDE OF A FIRE-DOOR SAFETY INSTALLATION

[75] Inventors: Rex H. Lasson, Princeton; William L. Downey, Peru; Roderick A. L. Ross, Princeton, all of Ill.

[73] Assignee: Schlage Lock Company, San Francisco, Calif.

[21] Appl. No.: 690,403

[22] Filed: Jul. 25, 1996

Related U.S. Application Data

[63] Continuation of Ser. No. 233,107, Apr. 25, 1994, abandoned.

[51] Int. Cl.[6] ..... E05F 1/08; E05F 15/20

[52] U.S. Cl. ..... 16/79; 16/48.5; 16/52

[58] Field of Search ..... 16/79, 71, 72, 16/78, 80, 51, 49, 52, DIG. 17, DIG. 21, 48.5, 222; 292/DIG. 12, DIG. 15; 49/7, 8

[56] References Cited

U.S. PATENT DOCUMENTS

| | | | |
|---|---|---|---|
| 2,043,198 | 6/1936 | Heverly | 16/48.5 |
| 2,954,106 | 9/1960 | Schlage | 16/48.5 |
| 3,546,734 | 12/1970 | Pollack et al. | 16/52 |
| 3,644,209 | 2/1972 | Nowotny et al. | 252/78 |
| 3,657,128 | 4/1972 | Street | 252/78 |
| 3,875,612 | 4/1975 | Poitras | 16/48.5 |
| 3,934,306 | 1/1976 | Farris | 16/48.5 |
| 4,148,111 | 4/1979 | Lieberman | 16/59 |
| 4,161,804 | 7/1979 | D'Hooge et al. | 16/48.5 |
| 4,179,092 | 12/1979 | Miyazawa | 16/71 |
| 4,256,293 | 3/1981 | Burgess | 16/52 |
| 4,267,619 | 5/1981 | Suska | 16/48.5 |
| 4,360,443 | 11/1982 | Durr, Jr. | 252/76 |
| 4,831,687 | 5/1989 | Lin et al. | 16/49 |
| 4,967,444 | 11/1990 | Korling et al. | 16/48.5 |
| 5,187,835 | 2/1993 | Lee | 16/52 |

FOREIGN PATENT DOCUMENTS

| | | |
|---|---|---|
| 0 545 680 | 6/1993 | European Pat. Off. . |
| 2 303 934 | 8/1973 | Germany . |
| 4 134 509 | 4/1993 | Germany . |
| 1 103 966 | 2/1968 | United Kingdom . |
| 1 531 869 | 11/1978 | United Kingdom . |
| 2 052 621 | 1/1981 | United Kingdom . |
| 2 156 950 | 10/1985 | United Kingdom . |

OTHER PUBLICATIONS

Hydraulics & Pneumatics, vol. 31, No.5, 1978, XP002015118 Protheroe: "Fire Resistant Hydraulic Fluids: New Capabilities Expand Applications".

*Primary Examiner*—Chuck Mah

*Attorney, Agent, or Firm*—Robert F. Palermo; Michael H. Minns

[57] ABSTRACT

A door control device for use on a non-fire side of a fire-door mounted in a door frame in a fire-door safety installation has a door closer assembly filled with a hydraulic damping fluid and attached to a non-fire side of the fire-door by at least one fastener; a door control arm pivotally connected to the door frame at a first end and to the door closer assembly at a second end; and the hydraulic damping fluid is one of a group of fire resistant hydraulic fluids.

12 Claims, 7 Drawing Sheets

DOOR CLOSER FOR THE NON-FIRE SIDE OF A FIRE-DOOR SAFETY INSTALLATION

This application is a continuation of application Ser. No. 08/233,107 filed Apr. 25, 1994 now abandoned.

BACKGROUND OF THE INVENTION

This invention relates generally to hydraulic fluid damped door closers and more particularly to fire resistant door closers incorporating features which discourage transfer of fire through a fire door.

Fire doors are designed to protect against passage of fire from one room to another in a building. In the U.S., the National Fire Protection Association promulgates construction and installation standards for fire doors and windows as a publication, NFPA 80. Listed fire doors are classified in twelve categories, and protection of an opening depends upon the use of a listed fire door, a listed frame, listed door hardware, and a listed door control device as specified under each door type. Fire classifications for buildings are specified in model building codes, government regulations, and state and local building codes. Fire door classifications are expressed in hourly ratings according to the Standard for Fire Tests of Door Assemblies-UL 10B, ANSI A2.2, ASTM E-152, CSFM 43.7, CAN4-S104(ULC-S104), UBC 43-2-1991, and NFPA 252.

The classifications are determined by exposing the doors to fire testing under standard conditions, and hourly ratings indicate the duration of exposure which the door can withstand, such as 4, 3, 2, 1½, 1, ¾ hours, and 30 or 20 minutes. It is permissible to test a fire door with special hardware and installation. This is usually done by door manufacturers who wish to establish a fire rated door, frame, door control, and hardware combination which can be specified in a building contract. It should be noted that, although there are several very similar fire door assembly tests in use throughout the world, there is no single international fire test standard.

Generally, fire doors must be maintained closed and latched or must automatically close and latch under a broad range of fire exposure conditions in order to properly serve their fire protective function. Thus, the door control device must assure that the door closes after it has been opened, and the latch must maintain the door latched. Today, most fire door tests are performed without a door control device, or, if included, the door control is mounted on the fire side of the door.

Most currently used door control devices employ hydraulic damping technology to control opening and closing speed of the door. The hydraulic fluid is commonly a petroleum based oil which is relatively inexpensive, plentiful, non-corrosive, and compatible with a wide range of metals and other materials. However, petroleum oils have an auto-ignition temperature ranging between approximately 500 and 750 degrees Fahrenheit and may contribute to the spread of the fire, if exposed to high temperatures, even when the door control device is mounted on the non-fire side of the door.

Within a few minutes after a fire begins, assuming it is adjacent to a fire door, the temperature of the door control device on the non-fire side of the door begins to increase by conduction through the door. This causes the hydraulic fluid to expand, to leak around the seals of the door control device, and to run down the door. Approximately 10 to 15 minutes after the fire starts, the temperature on the non-fire side of the door is high enough to cause auto-ignition of the leaking fluid. Even though the door and frame assembly may have a fire rating of 2 hours, or more, the fire has transferred through the door in less than 15 minutes.

The foregoing illustrates limitations known to exist in present door control devices. It would be advantageous to provide an alternative directed to overcoming one or more of those limitations. Accordingly, a suitable alternative is provided including features more fully disclosed hereinafter.

SUMMARY OF THE INVENTION

In one aspect of the present invention, a door control device is provided for use on a non-fire side of a fire-door mounted in a door frame in a fire-door safety installation, including a door closer assembly filled with a hydraulic damping fluid and attached to a non-fire side of the fire-door by at least one fastener; a door control arm pivotally connected to the door frame at a first end and to the door closer assembly at a second end; and, the hydraulic damping fluid comprises a fire resistant hydraulic fluid.

The foregoing and other aspects will become apparent from the following detailed description of the invention when considered in conjunction with the accompanying drawings.

DETAILED DESCRIPTION

Figure 1:
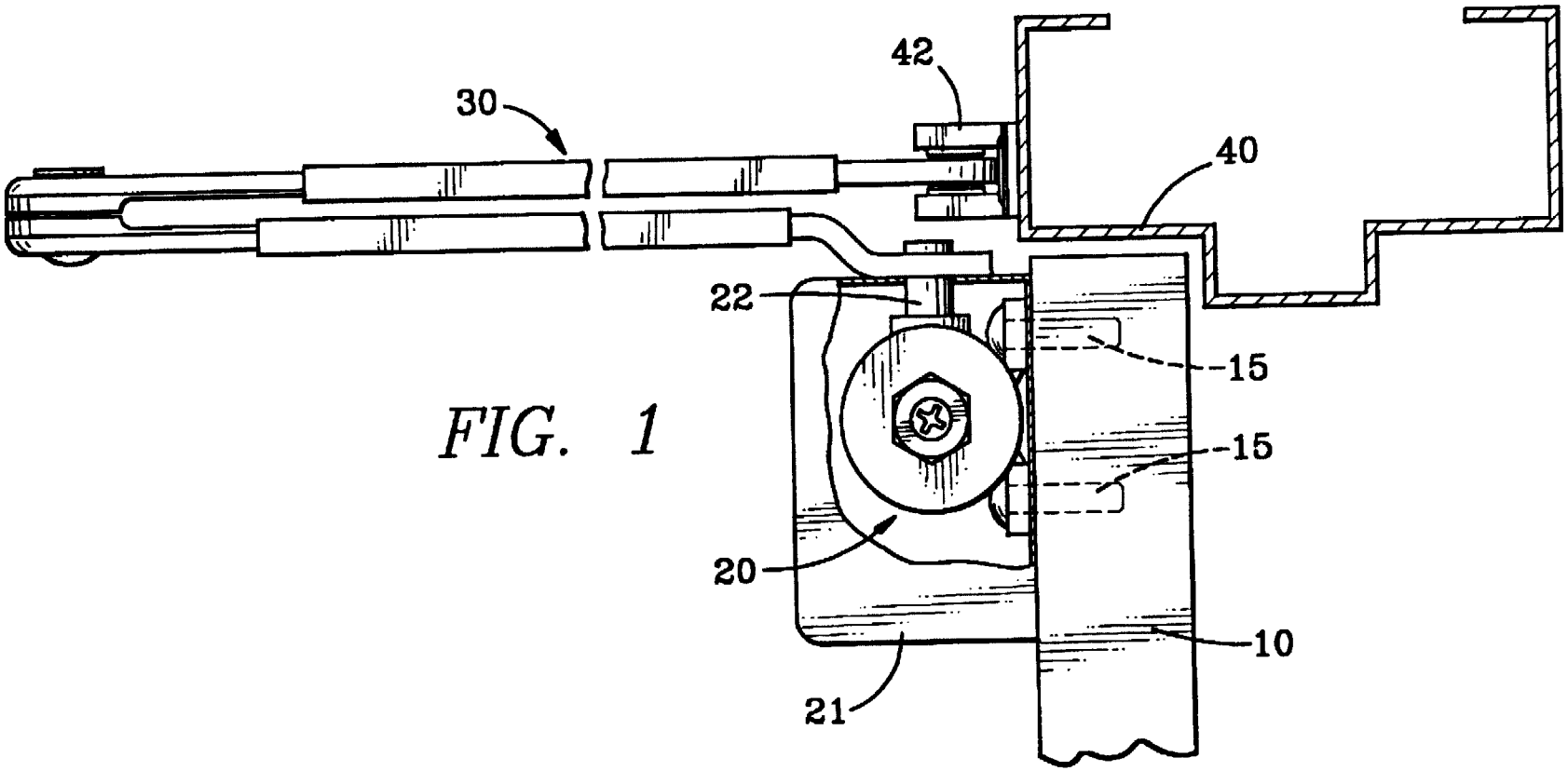
FIG. 1 is a fragmentary schematic elevational partially sectional view of a door control device illustrating the fusible bolt embodiment.
Figure 2A:
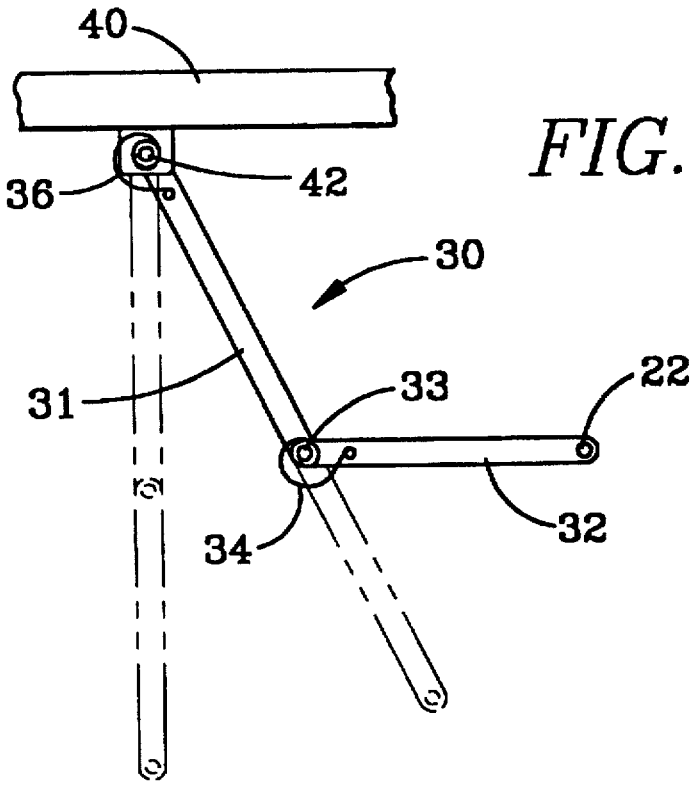
FIG. 2*a* and FIG. 2*b* are fragmentary schematic plan views showing the biased door control arm feature applied to two different types of door control arms.
Figure 2B:
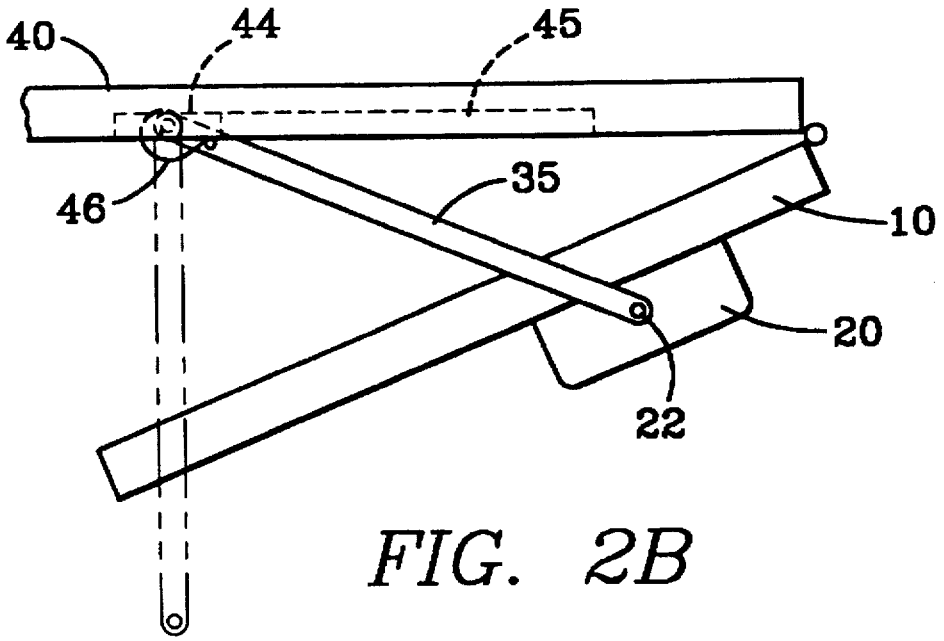

Ideally, all that is required for a door control for use on the non-fire side of a fire door is a hydraulic fluid which is completely impervious to heat, pressure, or combinations thereof which may cause auto-ignition, fluid leakage, viscosity degradation, boiling, or any of a myriad of breakdown mechanisms. In reality, virtually any hydraulic fluid can be made to ignite under some conditions, and to differing extents, all fluids contribute to corrosion or other attack upon the seals and other components. However, depending on the compositions of the seals and other parts of the door control, a fluid having adequate compatibility of properties can usually be found.

There are four groups of fire resistant fluids currently available for hydraulic applications. These are generally categorized according the relative amounts of oil and water contained, general resistance to temperature variation, compatibility with seal materials, wear protection afforded, and resistance to fluid breakdown. Although all presently available fluids will burn under certain conditions the fire hazard has been reduced in fire resistant fluids to a sufficient degree to render them acceptable in appropriate applications.

According to one standard of fire safety, Group I fluids include inhibited water-glycol fluids with other additives, such as basic amine doped diethylene glycol, diethylene polyglycol, polyalkaline glycol, and mixtures thereof. They do not generally attack ordinary packings and seals used in pumps and valves. Loss of water content in normal use through evaporation is reflected in an increase in viscosity of the fluid and consequent improper function of the hydraulic device. This serves as an automatic safeguard, in that equipment becomes inoperable before the fire hazard of the material is significantly increased by the decrease in water content.

Group II includes synthetics, such as phosphate-ester fluids, phosphate-ester based fluids, and halogenated hydrocarbon based fluids. These are stable homogeneous compounds in which characteristics do not change appreciably throughout their operational life. Since regular pump seals, packings, and gaskets may be attacked by these fluids, they should be replaced with materials that will not be so affected.

Water-oil emulsions are included in Group III. They present considerably lower fire hazard than all mineral oil, but because of proportions, the emulsion must be carefully maintained. Separation of oil from the emulsion may be caused by contamination of the system by chemical cleaners or solvents, temperatures above 150 degrees F. or below 50 degrees F., high pressure (1500–2000 PSI), and prolonged equipment shutdown or drum storage. It is, therefore, very important to adhere strictly to the manufacturers instructions regarding use and maintenance of the emulsion.

Group IV are the high water base fluids containing 70%, or more, of water. They have excellent fire resistance. They are, generally, made by adding synthetics or soluble oils to water. Because of the high water content, strict adherence to the manufacturer's instructions is very important to avoid premature component wear or failure.

In one embodiment of the present invention, the water-glycol fluids of Group I were selected due to their overall combination of properties. They are not compatible with lead, tin, zinc, cadmium, or magnesium and will cause corrosion and will degrade in contact with these materials. However, the materials from which door controls are made (aluminum, copper, brass, cast iron, steel) are not corroded by contact with the water-glycol mixtures. In addition, standard seal materials such as rubbers, Buna N, Buna S, and Neoprene, silicones, and PTFEs work well with water-glycols because they do not absorb water. Thus, most water resistant sealants are suitable for applications with the water-glycol family of fluids. For lubrication, only greases having good water tolerance such as lithium, calcium, and aluminum complex greases should be used. Water-glycol fluids are safe for handling since they have no nitrosamines, nitrates, nor any other suspected or established carcinogens. The composition is 41% water and a balance of diethylene-polyglycol with a basic amine corrosion inhibitor.

It should be noted that, for most standard fire door applications, the Group I water-glycols are adequate; however, there are also applications for which fluids from Groups II, III, or IV will be preferred due to special materials or service requirements. In any case, the choice of fluid will be made by considering at least the factors enumerated above with respect to the preferred embodiment.

As earlier stated, under the right conditions, any of the fire resistant fluids will ignite and burn. Thus, it is clear that, although the preferred embodiment serves the purpose of discouraging transfer of fire through a fire door, it does not fully eliminate the possibility of such. Additional features are provided which, when taken in conjunction with the fire resistant fluid and/or with each other, markedly improve the resistance of a fire door assembly to flame transfer.

Referring to FIG. 1, an important feature is apparent. A door 10 is hung within a door frame 40 to pivot on hinges which are not illustrated. A door control device 20 is mounted to the face of the door 10 and is concealed and protected by cover 21. Door control pinion 22 extends through cover 21 and engages one end of door control arm 30, the other end of which is pivotally attached to door frame pivot 42. Door control device 20 is attached to the door 10 by means of one or more fasteners 15 which are made from a material which is structurally strong enough to support the door control device 20 but is also fusible at a temperature lower than the auto-ignition point or flash point of the hydraulic fluid used in the door control device. Thus, if a standard petroleum oil hydraulic fluid, having an auto-ignition temperature of 500 to 750 degrees Fahrenheit (F.), were used in the door closer, it would be necessary to make the fasteners 15 from a material (such as alloys of zinc, lead, and tin) having a melting temperature less than about 500 degrees F. Note that it is not necessary for the fasteners 15 to completely melt in order for this feature to work. It is only necessary that, at a temperature which is below the auto-ignition temperature of the hydraulic fluid, the fastener fails because its strength becomes too low to support the weight of the door closer together with any spring action imposed by the door control arm 30. By selecting the hydraulic fluid from among the more fire resistant fluids described, it is possible to make fasteners 15 from materials having melting points on the order of 1000 degrees F., or more. Since it is mounted on the non-fire side of the door 10, the door control device 20 is heated solely by conduction of heat through door 10; therefore, fusible fasteners (or fastener) 15 are heated before the door control device 20 which is itself heated before the hydraulic fluid in the device. As a result of this heating sequence, the fusible fasteners 15 are assured of reaching their melting point and releasing door control device 20 from its attachment to the door 10 before the hydraulic fluid can heat enough to begin leaking, due to pressure induced by thermal expansion, and certainly before the fluid reaches its auto-ignition temperature.

Upon the fusion release of fasteners 15, door control device 20 will sag on door control arm 30 due to its weight and will consequently pivot away from contact with the door 10. This breaks the contact with the door 10 needed for conduction heating and, for all intents and purposes, makes further heating of the door control device 20 and its hydraulic fluid very unlikely.

FIGS. *2a* & *2b* illustrate another feature of the invention included as an additional assurance of decoupling between the door control device 20 and the door 10 upon fusion of the fasteners 15 of FIG. 1. The door control arm 30 of FIG. *2a* is made up of an end 31 attached, at one extreme, to door frame pivot 42 on door frame 40 and, at the other extreme, to another end 32 by a connecting pivot 33. End 32 is also connected to door control device 20 through pinion 22. When released by fusion of the fasteners, or by any other means, bias springs 36 and 34 act between arm 31 and pivot 42 and between arm 32 and arm 31 at pivot 33, respectively, to make the door control device swing away from the door in response to the door control arm 30 seeking a position perpendicular to the door frame 40. This further assures that the door control device 20 will break contact with fire door 10 and thereby avoid further conduction heating and auto ignition of the hydraulic oil, even with some frictional drag to overcome.

The illustration of FIG. *2b* shows another type of door control arm 35 made up of a single member connected to pinion 22 at the output of door control device 20, at one end, and pivotally connected, at the other end, to a slide 44 which slides in a straight track 45 along door frame 40 when the door is moved. Upon release of door control device 20 from door 10, biasing spring 46 causes arm 35 to seek a perpendicular orientation with respect to the door frame 40, thereby moving door control device 20 to its maximum distance from the door 10.

The desired result is achieved with either type of door control arm, i.e., the door control is separated from the door, which is heating, and the hydraulic fluid within the door control is protected from further conduction heating.

Figure 3A:
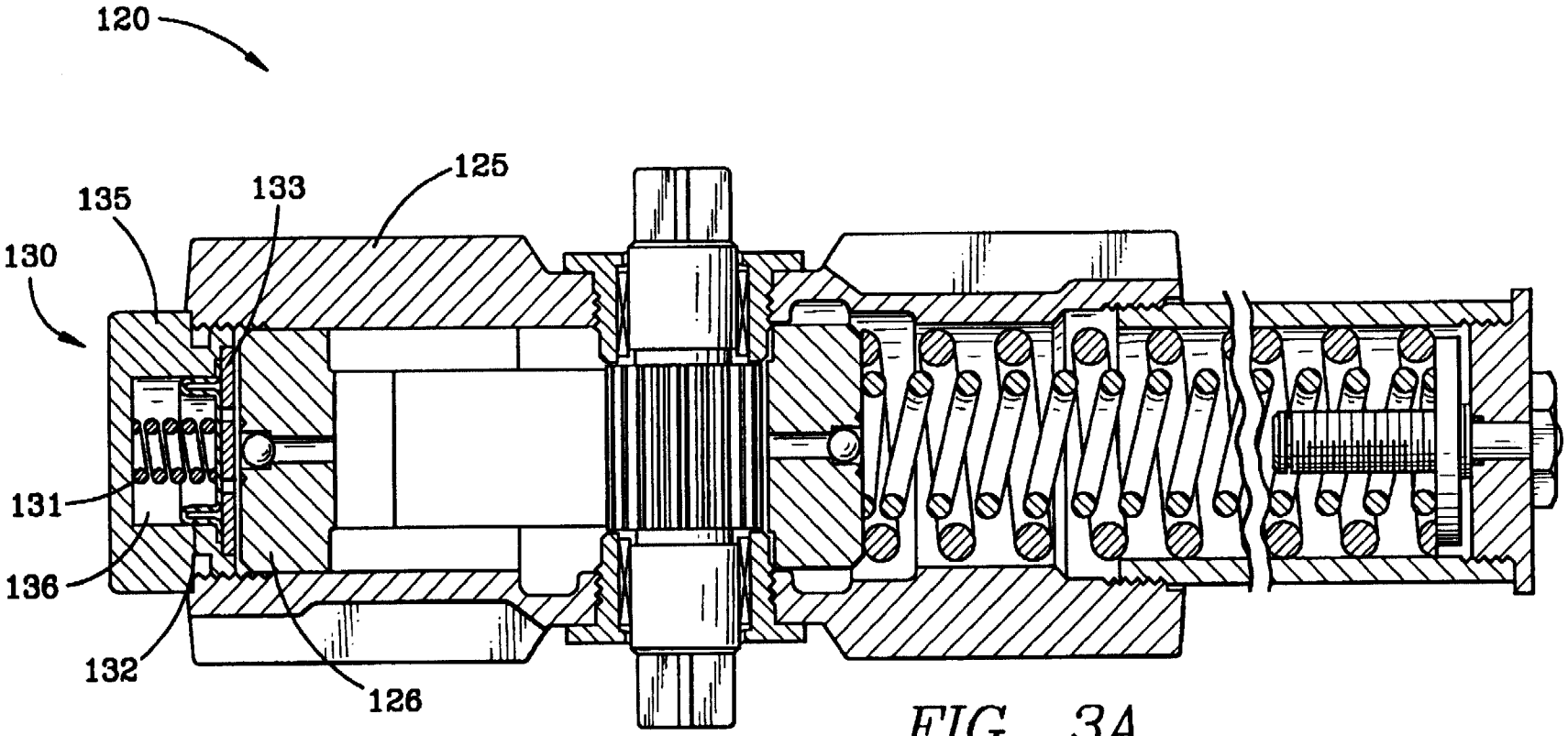
FIGS. 3*a*, 3*b*, 3*c*, 3*d*, and 3*e* are fragmentary schematic elevational partially sectional views of a door control device incorporating three alternative pressure compensation features and two variations thereof.
Figure 3B:
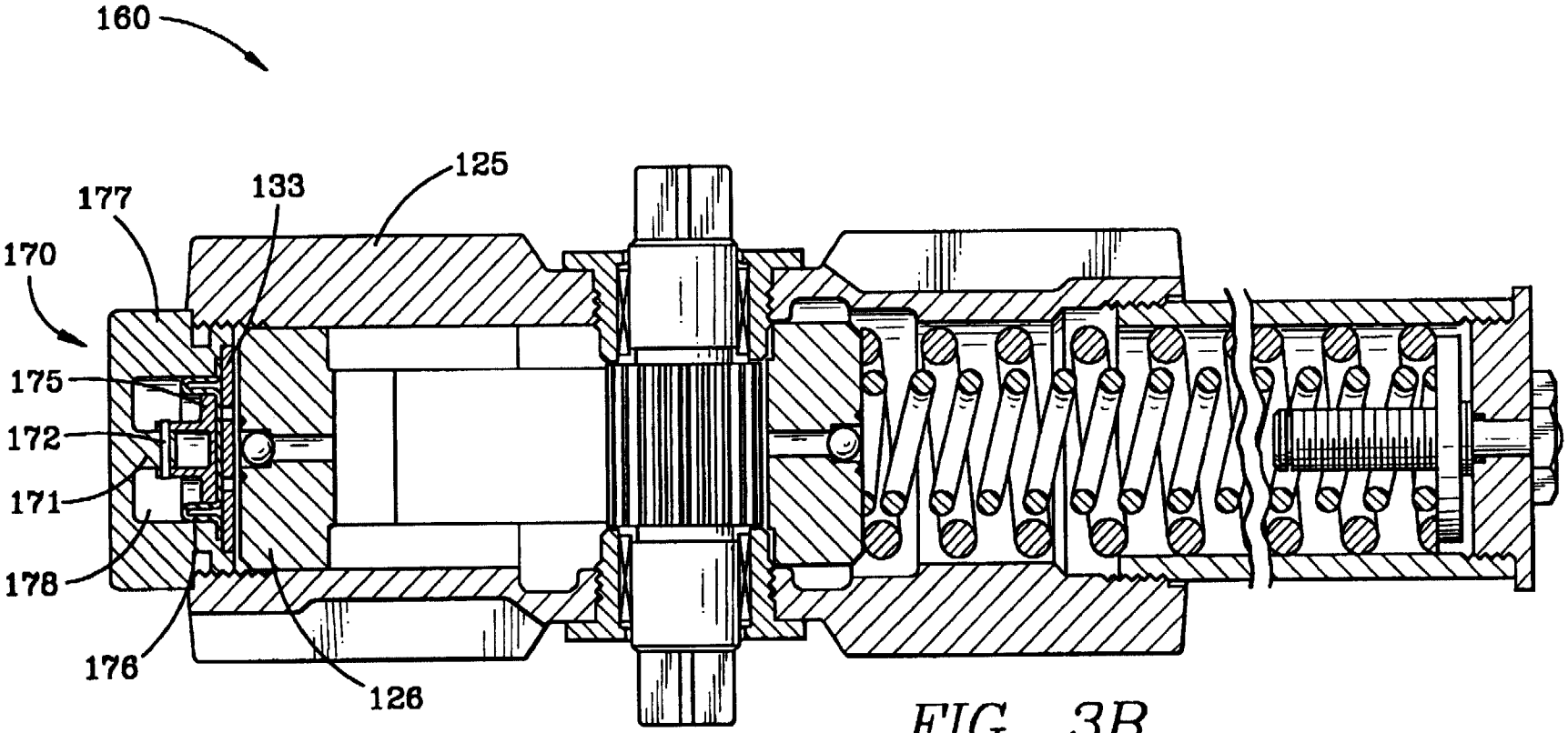
Figure 3C:
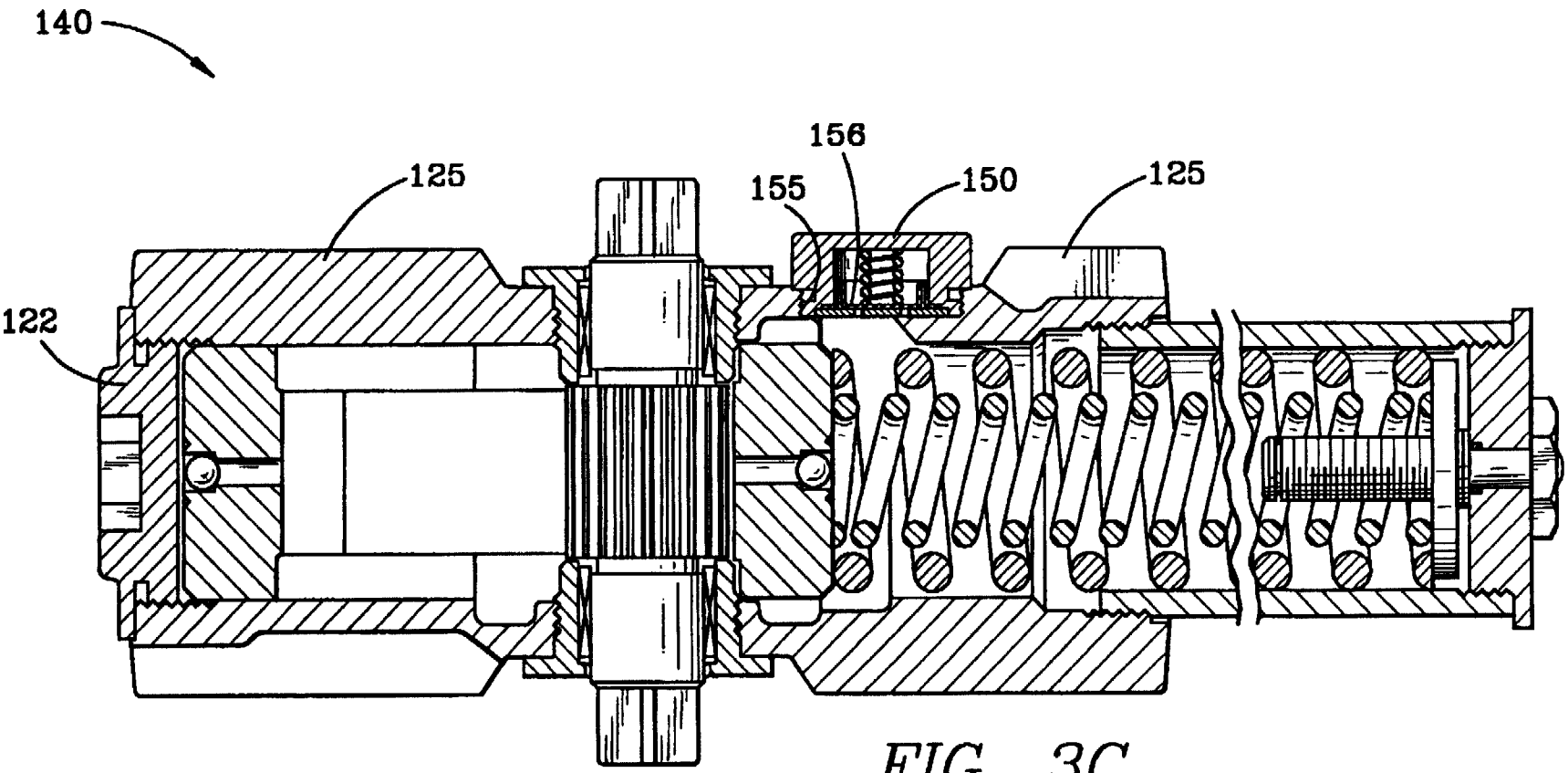

The features illustrated in FIGS. 3*a*–3*c* provide pressure compensation for decreasing the chance of hydraulic damping fluid leaking from the door control device when the door control is heated. For proper door control function, the device must be able to sustain a certain level of fluid pressure without leaking; and, since it is ideally completely filled with fluid at room temperature, any increase in fluid temperature results in a rapid pressure increase. Seals are employed to sustain operating pressure requirements together with pressure variations due to normal temperature fluctuations. The pressure limits for the seals of the door control device must not be exceeded if leakage and fire transfer due to auto-ignition is to be avoided.

FIG. 3*a* shows a pressure compensation device featuring a spring 131 which provides a preload just below the pressure limit for the seals of the door control or closer. For this embodiment, the door control 120 consists of a regular closer body 125 and an end plug 130 at the end of the piston cylinder. Plug 130 has a body 135, a cavity 136 within the body, a preload spring 131 within the cavity, a diaphragm 132 at the mouth of the cavity, and a preload retainer spider 133 over the diaphragm to retain it in place while permitting fluid access to the diaphragm in front of piston 126. Except for the cavity 136, which contains air, the entire closer 120 is filled with hydraulic fluid. When the fluid pressure exceeds the preload of spring 131, diaphragm 132 moves into cavity 136, thereby allowing the fluid to expand to relieve pressure, as the temperature increases, and sparing the seals of the closer 120. This prevents fluid leakage together with the attendant fire risk.

In FIG. 3*b*, closer 160 consists of regular closer body 125 and end plug 170. End plug 170 comprises a plug body 177, which has a cavity 178, a post 171 upon which a piston 175 is fitted for sliding but secured by a shear pin 172, and a diaphragm 176 sandwiched between piston 175 and a preload spider 133 for sealing cavity 178 away from the fluid which fills the closer body. Shear pin 172 is strong enough to withstand the pressure fluctuations associated with normal door closer operation; however, if the closer is exposed to excessive heat conducting through the fire door, the resulting thermal expansion of the fluid will increase hydrostatic pressure within the closer. When a pressure exceeding the preload limit (pressure limit for the seals) is reached, shear pin 172 fails, piston 175 moves leftward on post 171, and the hydrostatcic pressure is relieved so no fluid leaks from the closer 160. Here, as in the embodiment in FIG. 3*a*, the closer body is completely filled with fluid, and only the cavity of the end plug body contains air.

FIG. 3*c* has a different pressure absorbing arrangement. Here the pressure compensating plug assembly 150 is similar in design to that shown in FIG. 3*a* (130) but is installed in the atmospheric pressure portion of closer 140 which contains the springs. A regular end plug 122 is used along with a regular closer body 125, and only plug assembly 150, installed in threaded hole 155 is different. Elevated pressure is neither necessary nor desired in that portion of closer 140 since pressure in that region does not contribute to control of the door. Except for the ability to make plug assembly 150 somewhat less rugged than end plugs 130 and 170, this arrangement functions in the same way as those of FIGS. 3*a* and 3*b*. Of course, the required cavity volumes for the three plug assemblies will be determined by consideration of the size of the closer, fire door rating, volume of hydraulic fluid, type of fluid, closer operating pressure, seal materials, and seal pressure limits.

Figure 3D:
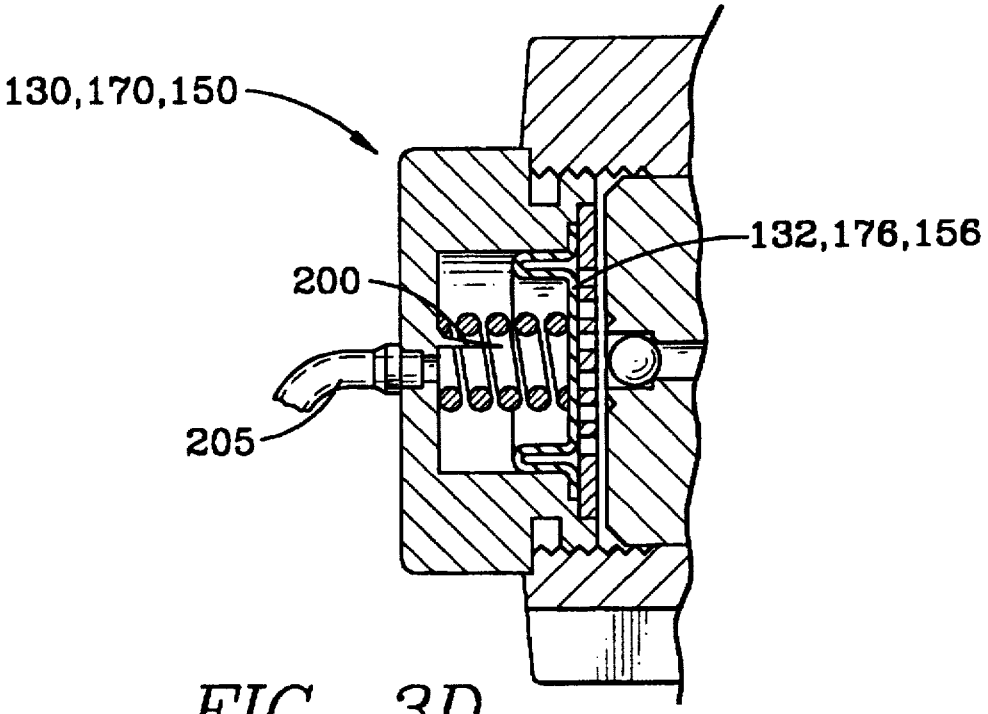
Figure 3E:
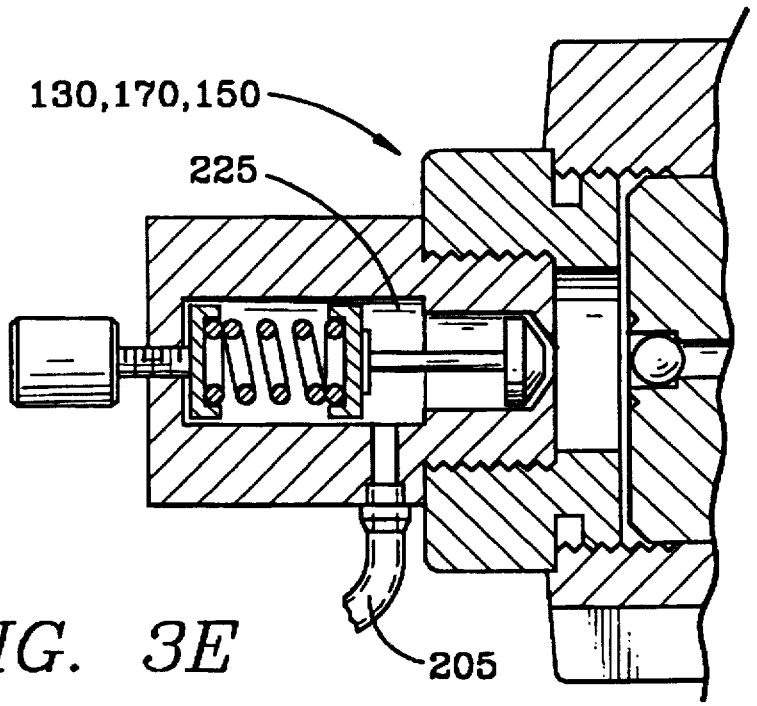

One of two final embodiments of the invention is illustrated in FIG. 3*d* and is a simple variation of those embodiments already illustrated in FIGS. 3*a*–3*c*. In this case, pressure compensating plugs 130, 170, and 150 are each fitted with a diaphragm piercing projection 200. The projection 200 is spaced from the diaphragm 132, 176, 156 sufficiently to permit the diaphragm to deflect enough to accommodate fluid expansion due to increase of temperature to two hundred degrees Fahrenheit or other appropriate limit. Deflections greater than that cause the diaphragm to be ruptured by the projection and the fluid to be safely drained away from the door in a closed conduit 205. The same function can also be provided in the pressure compensating plugs 130, 170, 150 by a resettable pressure relief valve 225, as illustrated in FIG. 3*e*, opening into the closed conduit 205; however, in that case, the pierceable diaphragm 132, 176, 156 would be replaced by the pressure relief valve 225.

Figure 4:
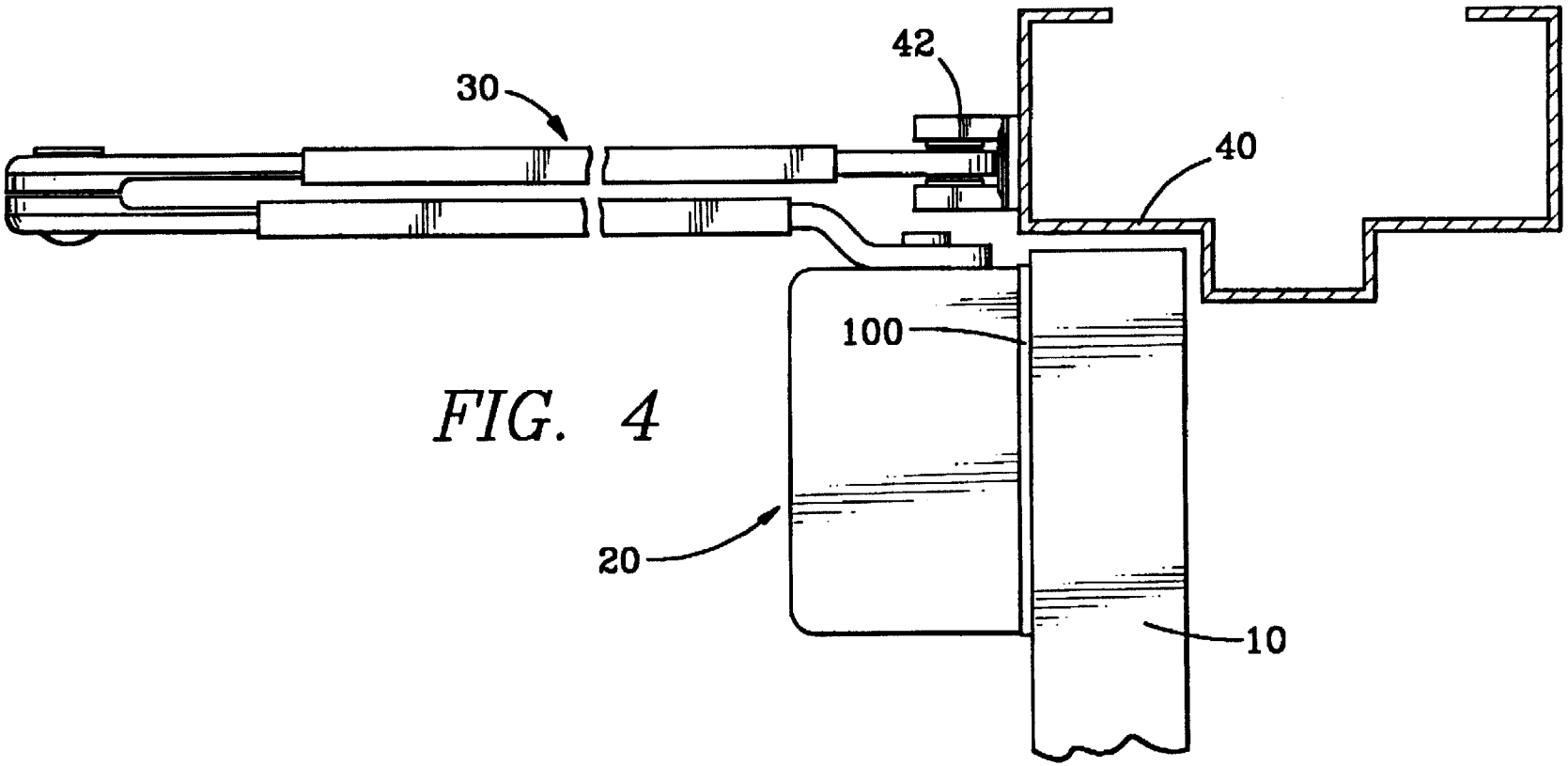
FIG. 4 is a fragmentary partially sectional elevation view illustrating the insulation feature of the present invention.

FIG. 4 illustrates another feature of the present invention for use alone or in conjunction with one or more of the previously described features. As in FIG. 1, a door 10 is mounted in door frame 40 and is controlled by door closer 20 through door control arm 30 which connects between the output spindle of closer 20 and door frame pivot 42. In this case, insulator 100 is interposed between door 10 and closer 20 to reduce its heating rate. Depending upon the insulating value of the insulator 100, that may be all that is needed for preventing fire transfer through the fire door.

Use of fire resistant damping fluid alone would serve the purpose of preventing or retarding the transfer of fire to the non-fire side of a fire door. However, most if not all fire resistant fluids can become inflammable under conditions which cause the non-inflammable components to evaporate or otherwise deteriorate. Therefore, the additional features disclosed herein are advantageous in that they each enhance the fire resistance of a fire door assembly which incorporates a door control or closer with these features. If they are used in combination, they can render a door control device "fire-proof" rather than fire resistant in a fire door assembly.

What is claimed is:

1. A door control device for use on a non-fire side of a fire-door mounted in a door frame in a fire-door safety installation, comprising:

a door closer assembly filled with a hydraulic damping fluid and attached to said non-fire side of said fire-door by at least one fastener;

a door control arm pivotally connected to said door frame at a first end and to said door closer assembly at a second end; and said at least one fastener being made from a material which has a melting point lower than an auto-ignition temperature for said hydraulic damping fluid.

2. The door control device of claim 1, further comprising:

biasing means for causing said door control arm to seek a perpendicular orientation with respect to said door frame when the second end of said arm is free.

3. The door control device of claim 2, further comprising:

means for thermally insulating said door closer assembly to inhibit heat transfer from said fire door to said door closer assembly.

4. The door control device of claim 1, further comprising:

means for thermally insulating said door closer assembly to inhibit heat transfer from said fire door to said door closer assembly.

5. The door control device of claim 1, wherein said hydraulic damping fluid comprises a fire resistant hydraulic fluid.

6. A door control device for use on a non-fire side of a fire-door mounted in a door frame in a fire-door safety installation, comprising:

a door closer assembly filled with a hydraulic damping fluid and attached to said non-fire side of said fire-door by at least one fastener;

a door control arm pivotally connected to said door frame at a first end and to said door closer assembly at a second end; and means, in said door closer assembly, for providing pressure compensation such that, when heated by contact of the door closer with the fire door, the hydraulic damping fluid occupies a low pressure volume inside said door closer and relieves thermal expansion pressure therein.

7. The door control device of claim 6, further comprising:

means for thermally insulating said door closer assembly to inhibit heat transfer from said fire door to said door closer assembly.

8. The door control device of claim 6, wherein said hydraulic damping fluid comprises a fire resistant hydraulic fluid.

9. A door control device for use on a non-fire side of a fire door mounted in a fire-door frame in a fire-door safety installation, comprising:

a door closer assembly attached to said non-fire side of said fire by at least one fastener and filled with a hydraulic damping fluid, said hydraulic damping fluid having a thermal expansion characteristic which causes a pressure increase in said door closer upon heating thereof;

a door arm pivotally connected to said door frame at a first end and to said door closer assembly at a second end; and a pressure compensation mean for limiting fluid pressure in said door closer assembly when said door closer is completely filled with a hydraulic fluid at room temperature and heated.

10. The door control device of claim 9, wherein the pressure compensation means for limiting fluid pressure in said door closer assembly comprises a pressure compensating plug having an air filled cavity with a drainage port, a diaphragm covering said cavity and preventing entry of hydraulic fluid, and projecting means for piercing said diaphragm, when the diaphragm is displaced toward said projecting means by hydraulic fluid pressure which increases due to an increase of temperature caused by contact of said door closer assembly with said fire-door, and for thereby permitting said fluid to drain through said drainage port away from said fire-door in a closed conduit.

11. The door control device of claim 9, wherein the pressure compensation means for limiting fluid pressure in said door closure assembly comprises a pressure relief valve, on a pressure compensating plug, for relieving fluid pressure whenever said pressure exceeds a set point pressure of said pressure relief valve and for thereby permitting said fluid to drain from said door closer in a closed conduit without contacting the surface of the door.

12. A door control device for use on a non-fire side of a fire-door mounted in a door frame in a fire-door safety installation, comprising:

a door closer assembly filled with a hydraulic damping fluid and attached to said non-fire side of said fire-door by at least one fastener;

a door control arm pivotally connected to said door frame at a first end and to said door closer assembly at a second end; and means for thermally insulating said door closer assembly to inhibit heat transfer from said fire door to said door closer assembly.

* * * * *